US011639574B2

(12) United States Patent
Kim et al.

(10) Patent No.: US 11,639,574 B2
(45) Date of Patent: May 2, 2023

(54) LAUNDRY TREATING APPARATUS

(71) Applicant: LG Electronics Inc., Seoul (KR)

(72) Inventors: Dongcheol Kim, Seoul (KR); Youngjong Kim, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 17/393,942

(22) Filed: Aug. 4, 2021

(65) Prior Publication Data

US 2022/0074102 A1 Mar. 10, 2022

(30) Foreign Application Priority Data

Sep. 4, 2020 (KR) ..... 10-2020-0113174

(51) Int. Cl.
*D06F 37/30* (2020.01)
*D06F 37/12* (2006.01)
*D06F 23/04* (2006.01)

(52) U.S. Cl.
CPC ..... *D06F 37/304* (2013.01); *D06F 23/04* (2013.01); *D06F 37/12* (2013.01)

(58) Field of Classification Search
None
See application file for complete search history.

(56) References Cited

U.S. PATENT DOCUMENTS 4,693,095 A 9/1987 Burk et al.

FOREIGN PATENT DOCUMENTS

| | | | | |
|---|---|---|---|---|
| CN | 201003115 | | 1/2008 | |
| CN | 110804842 | | 2/2020 | |
| KR | 0128401 | Y1 * | 12/1998 | ..... D06F 17/10 |
| KR | 200128401 | | 12/1998 | |
| KR | 20170082437 | | 7/2017 | |
| KR | 20170082437 | A * | 7/2017 | ..... D06F 37/40 |

OTHER PUBLICATIONS

International Search Report and Written Opinion in International Appln. No. PCT/KR2021/009710, dated Nov. 23, 2021, 11 pages.

* cited by examiner

*Primary Examiner* — Cristi J Tate-Sims
(74) *Attorney, Agent, or Firm* — Fish & Richardson P.C.

(57) ABSTRACT

Disclosed is a laundry treating apparatus including a tub for providing therein a space for water to be stored, a drum rotatably disposed inside the tub and providing therein a space for clothes to be stored, wherein the drum includes an open surface for inserting and withdrawing the clothes therethrough and a bottom surface located on an opposite side of the open surface, a pulsator rotatably disposed on the bottom surface and inside the drum, an agitator protruding from the pulsator inside the drum and extending toward the open surface, wherein the agitator is rotatably disposed at a center of the pulsator, and a driver configured to drive at least one of the drum, the pulsator, and the agitator. The pulsator and the agitator may be configured to rotate in opposite directions.

13 Claims, 5 Drawing Sheets

LAUNDRY TREATING APPARATUS

CROSS-REFERENCE TO RELATED APPLICATION

This application claims the benefit of Korean Patent Application No. 10-2020-0113174, filed on Sep. 4, 2020, which is hereby incorporated by reference as if fully set forth herein.

TECHNICAL FIELD

The present disclosure relates to a laundry treating apparatus having a rotator disposed in a drum.

BACKGROUND

A laundry treating apparatus is an apparatus that puts clothes, bedding, and the like (hereinafter, referred to as laundry) into a drum to remove contamination from the laundry. The laundry treating apparatus may perform processes such as washing, rinsing, dehydration, drying, and the like. The laundry treating apparatuses may be classified into a top loading type laundry treating apparatus and a front loading type laundry treating apparatus based on a scheme of putting the laundry into the drum.

The laundry treating apparatus may include a housing forming an appearance of the laundry treating apparatus, a tub accommodated in the housing, a drum that is rotatably mounted inside the tub and into which the laundry is put, and a detergent feeder that feeds detergent into the drum.

When the drum is rotated by a motor while wash water is supplied to the laundry accommodated in the drum, dirt on the laundry may be removed by friction with the drum and the wash water.

In one example, a rotator may be disposed inside the drum to improve a laundry washing effect. The rotator may be rotated inside the drum to form a water flow, and the laundry washing effect may be improved by the rotator.

In general, the rotator includes a pulsator rotatably disposed on a bottom surface of the drum, and an agitator rotatably disposed at a center of the pulsator.

A conventional laundry treating apparatus had a limitation in that a three-dimensional water flow is not able to be formed because the pulsator and the agitator included in the rotator are configured to rotate in the same direction.

In one example, to overcome such limitation, U.S. Pat. No. 5,931,029 (hereinafter, referred to as Prior Art literature) discloses a laundry treating apparatus that independently rotates the pulsator and the agitator using two motors. However, in the case of the laundry treating apparatus disclosed in the prior document, there are disadvantages in that a structure is complicated and price competitiveness is lowered compared to a case of using one motor.

SUMMARY

One of various tasks of the present disclosure is to provide a laundry treating apparatus including a pulsator and an agitator rotatable in opposite directions.

A laundry treating apparatus according to exemplary embodiments of the present disclosure may include a pulsator and an agitator configured to rotate in opposite directions, and the pulsator and the agitator may be driven by a driver including one driving motor and two gear assemblies, each of which is of a planetary gear-type.

According to an aspect of the present disclosure, provided is a laundry treating apparatus including a tub for providing therein a space for water to be stored, a drum rotatably disposed inside the tub and providing therein a space for clothes to be stored, wherein the drum includes an open surface for inserting and withdrawing the clothes therethrough and a bottom surface located on an opposite side of the open surface, a pulsator rotatably disposed on the bottom surface and inside the drum, an agitator protruding from the pulsator inside the drum and extending toward the open surface, wherein the agitator is rotatably disposed at a center of the pulsator, and a driver configured to drive at least one of the drum, the pulsator, and the agitator, wherein the pulsator and the agitator are configured to rotate in opposite directions.

In one implementation, the driver may include a driving motor disposed outside the tub, wherein the driving motor generates rotational force, a drum rotation shaft disposed to pass through the tub, wherein the drum rotation shaft has one end fixed to the drum and the other end located outside the tub, wherein the drum rotation shaft is configured as a hollow shaft, a driving shaft having one end located inside the drum rotation shaft and the other end fixed to the driving motor, a first pulsator rotation shaft having one end protruding through the bottom surface of the drum toward the open surface of the drum, and the other end located inside the drum rotation shaft, a second pulsator rotation shaft constituting a central shaft of rotation of the pulsator, wherein the second pulsator is configured as a hollow shaft to provide therein a space for storing said one end of the first pulsator rotation shaft, an agitator rotation shaft disposed to pass through a top surface of the second pulsator rotation shaft, wherein the agitator rotation shaft has one end fixed to the agitator and the other end located inside the second pulsator rotation shaft, and a clutch for transmitting rotational force provided from the driving motor to the drum rotation shaft when the driving motor and the drum rotation shaft are connected to each other, and blocking rotational force provided from the driving motor when the driving motor and the drum rotation shaft are separated from each other.

In one implementation, the agitator may be configured to rotate in the same direction as a rotation direction of rotational force provided by the driving motor, and the pulsator may be configured to rotate in a direction opposite to the rotation direction of rotational force provided by the driving motor.

In one implementation, the driver may further include a first gear assembly disposed inside the drum rotation shaft, and between said one end of the driving shaft and the other end of the first pulsator rotation shaft, wherein the first gear assembly transmits rotational force transmitted by the driving shaft to each of the drum rotation shaft and the first pulsator rotation shaft, and a second gear assembly disposed inside the second pulsator rotation shaft, and between said one end of the first pulsator rotation shaft and the other end of the agitator rotation shaft, wherein the second gear assembly transmits rotational force transmitted by the first pulsator rotation shaft to each of the second pulsator rotation shaft and the agitator rotation shaft. The pulsator may be configured to rotate by rotational force sequentially transmitted through the driving shaft, the first gear assembly, the first pulsator rotation shaft, the second gear assembly, and the second pulsator rotation shaft, and the agitator may be configured to rotate by rotational force sequentially transmitted through the driving shaft, the first gear assembly, the first pulsator rotation shaft, the second gear assembly, and the agitator rotation shaft.

In one implementation, each of the first gear assembly and the second gear assembly may include a driving gear and a plurality of driven gears transmitting power while rotating around the driving gear, the first gear assembly may transmit rotational force in the same direction as a rotation direction of rotational force transmitted by the driving shaft to the first pulsator rotation shaft, and transmit rotational force in a direction opposite to the rotation direction of rotational force transmitted by the driving shaft to the drum rotation shaft, and the second gear assembly may transmit rotational force in the same direction as a rotation direction of rotational force transmitted by the first pulsator rotation shaft to the agitator rotation shaft, and transmit rotational force in a direction opposite to the rotation direction of rotational force transmitted by the first pulsator rotation shaft to the second pulsator rotation shaft.

According to another aspect of the present disclosure, provided is a laundry treating apparatus including a tub for providing therein a space for water to be stored, a drum rotatably disposed inside the tub and providing therein a space for clothes to be stored, wherein the drum includes an open surface for inserting and withdrawing the clothes therethrough and a bottom surface located on an opposite side of the open surface, a pulsator rotatably disposed on the bottom surface and inside the drum, an agitator protruding from the pulsator inside the drum and extending toward the open surface, wherein the agitator is rotatably disposed at a center of the pulsator, and a driver configured to drive at least one of the drum, the pulsator, and the agitator. The driver includes a driving motor disposed outside the tub, wherein the driving motor generates rotational force, a drum rotation shaft disposed to pass through the tub, wherein the drum rotation shaft has one end fixed to the drum and the other end located outside the tub, a driving shaft having one end located inside the drum rotation shaft and the other end fixed to the driving motor, a first pulsator rotation shaft having one end protruding through the bottom surface of the drum toward the open surface of the drum, and the other end located inside the drum rotation shaft, a first gear assembly disposed inside the drum rotation shaft, and between said one end of the driving shaft and the other end of the first pulsator rotation shaft, wherein the first gear assembly transmits rotational force transmitted by the driving shaft to each of the drum rotation shaft and the first pulsator rotation shaft, a second pulsator rotation shaft constituting a central shaft of rotation of the pulsator, wherein the second pulsator provides therein a space for storing said one end of the first pulsator rotation shaft, an agitator rotation shaft disposed to pass through a top surface of the second pulsator rotation shaft, wherein the agitator rotation shaft has one end fixed to the agitator and the other end located inside the second pulsator rotation shaft, a second gear assembly disposed inside the second pulsator rotation shaft, and between said one end of the first pulsator rotation shaft and the other end of the agitator rotation shaft, wherein the second gear assembly transmits rotational force transmitted by the first pulsator rotation shaft to each of the second pulsator rotation shaft and the agitator rotation shaft, and a clutch for transmitting rotational force provided from the driving motor to the drum rotation shaft when the driving motor and the drum rotation shaft are connected to each other, and blocking rotational force provided from the driving motor when the driving motor and the drum rotation shaft are separated from each other.

In one implementation, the pulsator may be configured to rotate by rotational force sequentially transmitted through the driving shaft, the first gear assembly, the first pulsator rotation shaft, the second gear assembly, and the second pulsator rotation shaft.

In one implementation, the agitator may be configured to rotate by rotational force sequentially transmitted through the driving shaft, the first gear assembly, the first pulsator rotation shaft, the second gear assembly, and the agitator rotation shaft.

In one implementation, the first gear assembly may include a first driving gear rotatably disposed inside the drum rotation shaft and fixed to said one end of the driving shaft, a first connecting gear disposed along an inner circumferential surface of the drum rotation shaft, a plurality of first driven gears disposed along a circumferential surface of the first driving gear to connect the first driving gear with the first connecting gear, and a first cage rotatably disposed inside the drum rotation shaft, wherein the first cage rotatably fixes the plurality of first driven gears, and the first pulsator rotation shaft may be configured to connect a top surface of the first cage with the second gear assembly.

In one implementation, the second gear assembly may include a second driving gear rotatably disposed inside the second pulsator rotation shaft and fixed to said one end of the first pulsator rotation shaft, a second connecting gear disposed along an inner circumferential surface of the second pulsator rotation shaft, a plurality of second driven gears disposed along a circumferential surface of the second driving gear to connect the second driving gear with the second connecting gear, and a second cage rotatably disposed inside the second pulsator rotation shaft, wherein the second cage rotatably fixes the plurality of second driven gears, and the agitator rotation shaft may be configured to connect the second cage with the agitator.

In one implementation, the first driving gear may be configured to spin in the same direction (a first direction) as a rotation direction of the driving shaft, and each of the plurality of first driven gears may be configured to spin in a direction (a second direction) opposite to the rotation direction of the driving shaft.

In one implementation, the plurality of first driven gears may be configured to orbit in the first direction around the first driving gear, and the first cage, the first pulsator rotation shaft, and the second driving gear may be configured to spin together in the first direction.

In one implementation, each of the plurality of second driven gears may be configured to spin in the second direction, and the second pulsator rotation shaft and the pulsator may be configured to rotate together in the second direction.

In one implementation, the plurality of second driven gears may be configured to orbit in the first direction around the second driving gear, and the second cage, the agitator rotation shaft, and the agitator may be configured to spin together in the first direction.

In one implementation, each of the drum rotation shaft and the second pulsator rotation shaft may be configured as a hollow shaft, and each of the first pulsator rotation shaft and the agitator rotation shaft may be configured as a solid shaft.

The laundry treating apparatus according to exemplary embodiments of the present disclosure may include the drum rotatably disposed inside the tub and providing therein the space for the clothes to be stored, the pulsator rotatably disposed on the bottom surface and inside the drum, the agitator protruding from the pulsator inside the drum and extending toward the open surface, wherein the agitator is rotatably disposed at the center of the pulsator, and the driver configured to drive at least one of the drum, the pulsator, and the agitator.

In this connection, the pulsator and the agitator may be configured to rotate in the opposite directions. Accordingly, the laundry treating apparatus may form a three-dimensional water flow.

In one example, the driver may be composed of the single driving motor and the two gear assemblies, each of which is of the planetary gear-type. Accordingly, compared to a laundry treating apparatus using a plurality of driving motors, the structure may be simplified and the price competitiveness may also be improved.

DETAILED DESCRIPTION

Hereinafter, a specific embodiment of the present disclosure will be described with reference to the drawings. A following detailed description is provided to provide a comprehensive understanding of a method, an apparatus, and/or a system described herein. However, this is merely an example and the present disclosure is not limited thereto.

In describing embodiments of the present disclosure, when it is determined that a detailed description of the prior art related to the present disclosure may unnecessarily obscure the gist of the present disclosure, the detailed description thereof will be omitted. In addition, terms to be described later are terms defined in consideration of functions in the present disclosure, which may vary based on intentions of users and operators, customs, or the like. Therefore, a definition thereof should be made based on a content throughout this specification. The terminology used in the detailed description is for the purpose of describing embodiments of the present disclosure only, and should not be limiting. As used herein, the singular forms 'a' and 'an' are intended to include the plural forms as well, unless the context clearly indicates otherwise. It should be understood that the terms 'comprises', 'comprising', 'includes', and 'including' when used herein, specify the presence of the features, numbers, steps, operations, components, parts, or combinations thereof described herein, but do not preclude the presence or addition of one or more other features, numbers, steps, operations, components, or combinations thereof.

In addition, in describing the components of the embodiment of the present disclosure, terms such as first, second, A, B, (a), (b) may be used. Such terms are only for distinguishing the component from other components, and the essence, order, or order of the component is not limited by the term.

Figure 1:
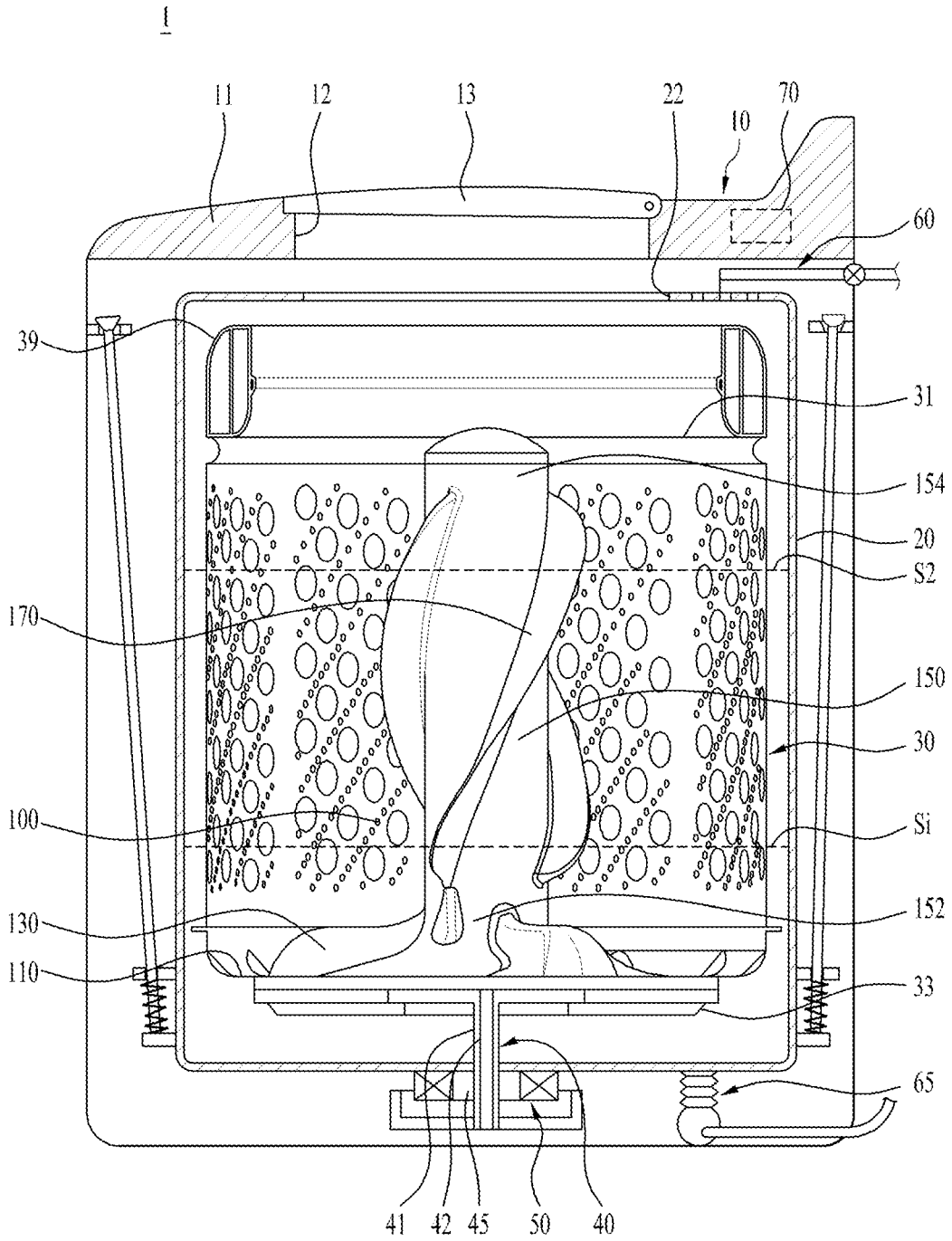
FIG. 1 is a view showing an interior of a laundry treating apparatus according to an embodiment of the present disclosure.

FIG. 1 shows an interior of a laundry treating apparatus 1 according to an embodiment of the present disclosure. The laundry treating apparatus 1 may include a cabinet 10, a tub 20, and a drum 30.

The cabinet 10 may be in any shape as long as being able to accommodate the tub 20, and FIG. 1 shows a case in which the cabinet 10 forms an appearance of the laundry treating apparatus 1 as an example.

The cabinet 10 may have a laundry inlet 12 defined therein for putting laundry into the drum 30 or withdrawing the laundry stored in the drum 30 to the outside, and may have a laundry door 13 for opening and closing the laundry inlet 12.

FIG. 1 shows that a laundry inlet 12 is defined in a top surface 11 of a cabinet 10 according to an embodiment of the present disclosure, and a laundry door 13 for opening and closing the laundry inlet 12 is disposed on the top surface 11. However, the laundry inlet 12 and the laundry door 13 are not necessarily limited to being defined in and disposed on the top surface 11 of the cabinet 10.

A tub 20 is means for storing water necessary for washing laundry. The tub 20 may have a tub opening 22 defined therein in communication with the laundry inlet 12. For example, one surface of the tub 20 may be opened to define the tub opening 22. At least a portion of the tub opening 22 may be positioned to face the laundry inlet 12, so that the tub opening 22 may be in communication with the laundry inlet 12.

FIG. 1 shows a top loading type laundry treating apparatus 1 according to an embodiment of the present disclosure. Therefore, FIG. 1 shows that a top surface of the tub 20 is opened to define the tub opening 22, and the tub opening 22 is positioned below the laundry inlet 12 and in communication with the laundry inlet 12.

The tub 20 is fixed at a location inside the cabinet 10 through a tub support (not shown). The tub support may be in a structure capable of damping vibrations generated in the tub 20.

The tub 20 is supplied with water through a water supply 60. The water supply 60 may be composed of a water supply pipe that connects a water supply source with the tub 20, and a water supply valve that opens and closes the water supply pipe.

The laundry treating apparatus 1 according to an embodiment of the present disclosure may include a detergent feeder that stores detergent therein and is able to supply the detergent into the tub 20. As the water supply 60 supplies water to the detergent feeder, the water that has passed through the detergent feeder may be supplied to the tub 20 together with the detergent.

In addition, the laundry treating apparatus 1 according to an embodiment of the present disclosure may include a water sprayer that sprays water into the tub 20 through the tub opening 22. The water supply 60 may be connected to the water sprayer to supply water directly into the tub 20 through the water sprayer.

The water stored in the tub 20 is discharged to the outside of the cabinet 10 through a drain 65. The drain 65 may be composed of a drain pipe that guides the water inside the tub 20 to the outside of the cabinet 10, a drain pump disposed on the drain pipe, and a drain valve for controlling opening and closing of the drain pipe.

The drum 30 may be rotatably disposed inside the tub 20. The drum 30 may be configured to have a circular cross-section in order to be rotatable inside the tub 20. For example, the drum 30 may be in a cylindrical shape as shown in FIG. 1.

The drum 30 may have a drum opening defined therein positioned below the tub opening 22 to communicate with the inlet. One surface of the drum 30 may be opened to define an open surface 31 as will be described later, and the open surface 31 may correspond to the drum opening.

A plurality of drum through-holes that communicate an interior and an exterior of the drum 30 with each other, that is, the interior of the drum 30 and an interior of the tub 20 divided by the drum 30 with each other may be defined in an outer circumferential surface of the drum 30. Accordingly, the water supplied into the tub 20 may be supplied to the interior of the drum 30 in which the laundry is stored through the drum through-holes.

The drum 30 may be rotated by a driver 50. The driver 50 may be composed of a stator fixed at a location outside the tub 20 and forming a rotating magnetic field when a current is supplied, a rotor rotated by the rotating magnetic field, and a rotation shaft 40 disposed to penetrate the tub 20 to connect the drum 30 and the like to the rotor.

As shown in FIG. 1, the rotation shaft 40 may be disposed to form a right angle with respect to a bottom surface of the tub 20. In this case, the laundry inlet 12 may be defined in the top surface 11 of the cabinet 10, the tub opening 22 may be defined in the top surface of the tub 20, and the drum opening may be defined in the top surface of the drum 30.

In one example, when the drum 30 rotates in a state in which the laundry is concentrated in a certain region inside the drum 30, a dynamic unbalance state (an unbalanced state) occurs in the drum 30. When the drum 30 in the unbalanced state rotates, the drum 30 rotates while vibrating by a centrifugal force acting on the laundry. The vibration of the drum 30 may be transmitted to the tub 20 or the cabinet 10 to cause a noise.

To avoid problems like this, the present disclosure may further include a balancer 39 that controls the unbalance of the drum 30 by generating a force to offset or damp the centrifugal force acting on the laundry.

In one example, referring to FIG. 1, the tub 20 may have a space defined therein in which the water may be stored, and the drum 30 may be rotatably disposed inside the tub 20. The drum 30 may include the open surface 31 through which the laundry enters and exits, and a bottom surface 33 positioned on an opposite side of the open surface 31.

FIG. 1 shows that the top surface of the drum 30 corresponds to the open surface 31, and the bottom surface thereof corresponds to the bottom surface 33 according to an embodiment of the present disclosure. As described above, the open surface 31 may correspond to a surface through which the laundry input through the laundry inlet 12 of the cabinet 10 and the tub opening 22 of the tub 20 passes.

In one example, the water supply 60 may be configured to be connected to the means such as the detergent feeder, the water sprayer, or the like to supply the water into the tub 20 as described above. In one example, an embodiment of the present disclosure may include a controller 70 that controls the water supply 60 to adjust a water supply amount in a washing process and the like.

The controller 70 is configured to adjust the amount of water supplied to the tub 20 in the washing process, a rinsing process, or the like. The amount of water supplied may be adjusted through a manipulation unit disposed on the cabinet 10 and manipulated by a user, or may be determined through an amount of laundry, a load of the driver 50, or the like.

A plurality of water supply amounts are preset in the controller 70, and the controller 70 may be configured to control the water supply 60 based on one of the preset water supply amounts in response to a command selected by a user or the like in the washing process or the like.

In one example, as shown in FIG. 1, an embodiment of the present disclosure may further include a rotator 100. The rotator 100 may be rotatably installed on the bottom surface 33 and inside the drum 30.

The rotator 100 may include a pulsator 103 rotatably disposed on the bottom surface 33 and inside the drum 30, and an agitator 105 that protrudes from the pulsator 103 inside the drum 30 and extends toward the open surface 31, and is rotatably disposed at a center of the pulsator 103.

In one embodiment of the present disclosure, the drum 30 and the rotator 100 may be configured to be rotatable, independently. A water flow may be formed by the rotation of the drum 30 and the rotator 100, and friction or collision with the laundry may occur, so that washing or rinsing of the laundry may be made.

Figure 2:
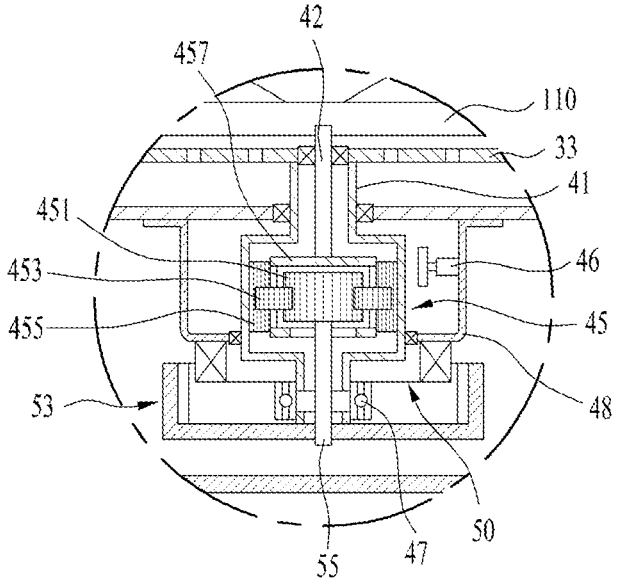
FIG. 2 is a view showing a rotation shaft coupled to a drum and a rotator in a laundry treating apparatus according to an embodiment of the present disclosure.

In one example, FIG. 2 shows the rotation shaft 40 coupled with the drum 30 and the rotator 100 according to an embodiment of the present disclosure.

Each of the drum 30 and the rotator 100 may be connected to the driver 50 through the rotation shaft 40 to receive a rotational force. In one embodiment of the present disclosure, the drum 30 may be rotated as a drum rotation shaft 41 is coupled to the bottom surface 33 thereof, and the rotator 100 may be rotated by being coupled to a first pulsator shaft 42 that passes through the bottom surface 33 and separately rotated with respect to the drum rotation shaft 41.

The first pulsator shaft 42 may rotate in a direction the same as or opposite to a rotation direction of the drum rotation shaft 41. The drum rotation shaft 41 and the first pulsator shaft 42 may receive power through one driver 50, and the driver 50 may be connected to a first gear assembly 45 that distributes the power to the drum rotation shaft 41 and the first pulsator shaft 42 and adjusts the rotation direction.

That is, a driving shaft 55 of the driver 50 may be connected to the first gear assembly 45 to transmit the power to the first gear assembly 45, and each of the drum rotation shaft 41 and the first pulsator shaft 42 may be connected to the first gear assembly 45 to receive the power.

The drum rotation shaft 41 may be configured as a hollow shaft, and the first pulsator shaft 42 may be configured as a solid shaft disposed inside the drum rotation shaft 41. Accordingly, one embodiment of the present disclosure may effectively provide the power to the drum rotation shaft 41 and the first pulsator shaft 42 parallel to each other through the single driver 50.

FIG. 2 shows a planetary gear-type first gear assembly 45, and shows a state in which each of the driving shaft 55, the drum rotation shaft 41, and the first pulsator shaft 42 is coupled to the first gear assembly 45. As the driving shaft 55 is able to transmit a rotational force through the planetary gear-type first gear assembly 45, the driving shaft 55 may be referred to as a driving shaft 55. Hereinafter, the driving shaft 55 will be referred to as the driving shaft 55 for convenience of description.

Referring to FIG. 2, a rotational relationship of the drum rotation shaft 41 and the first pulsator shaft 42 in one embodiment of the present disclosure will be described as follows.

The driving shaft 55 of the driver 50 may be connected to a first driving gear 451 at a center of the planetary gear-type first gear assembly 45. When the driving shaft 55 is rotated, in the first gear assembly 45, a first driven gear 453 and a first connecting gear 455 may be rotated together by rotation of the first driving gear 451.

More specifically, the first gear assembly 45 may include the first driving gear 451 rotatably disposed inside the drum rotation shaft 41 and fixed to one end of the driving shaft 55, a first connecting gear 455 disposed along an inner circumferential surface of the drum rotation shaft 41, a plurality of first driven gears 453 disposed along a circumferential surface of the first driving gear 451 to connect the first driving gear 451 with the first connecting gear 455, and a first cage 457 rotatably disposed inside the drum rotation shaft 41 and rotatably fixing the plurality of first driven gears 453. The first pulsator rotation shaft 42 may be disposed to connect a top surface of the first cage 457 with a second gear assembly 49 to be described later.

In this connection, the drum rotation shaft 41 coupled to the bottom surface 33 of the drum 30 may be connected to the first connecting gear 455, and the first pulsator rotation shaft 42 may be connected to the first driven gear 453 via the first cage 457.

The first gear assembly 45 may transmit a rotational force in the same direction as a rotation direction of a rotational force transmitted by the driving shaft 55 to the first pulsator rotation shaft 42, and transmit a rotational force in a direction opposite to the rotation direction of the rotational force transmitted by the driving shaft 55 to the drum rotation shaft 41.

The first gear assembly 45 may include a clutch 47 and a brake 46 that may independently restrict the rotation of the rotation shaft 40 as needed. The first gear assembly 45 may further include a gear housing 48 fixed to the tub 20, and the clutch 47 may be disposed in the gear housing 48 to selectively restrict the rotation of the drum rotation shaft 41 connected to the first connecting gear 455.

In exemplary embodiments, the clutch 47 may transmit a rotational force provided from the driving motor 53 to the drum rotation shaft 41 when the driving motor 53 is connected to the drum rotation shaft 41, and block the rotational force provided from the driving motor 53 when the driving motor 53 and the drum rotation shaft 41 are separated from each other.

The brake 46 may be configured to mutually restrict or release the rotations of the driving shaft 55 and the first connecting gear 455. That is, the rotation of the first connecting gear 455 or the rotation of the drum rotation shaft 41 may be synchronized with or desynchronized with the driving shaft 55 by the brake 46.

In summary, the driver 50 may include a driving motor 53 disposed outside the tub 20 to generate the rotational force, the drum rotation shaft 41 disposed to pass through the tub 20, the driving shaft 55 for transmitting the rotational force provided from the driving motor 53, the first pulsator rotation shaft 42 for transmitting the rotational force transmitted from the driving shaft 55 into the drum 30, and the first gear assembly 45 disposed inside the drum rotation shaft 41.

One end of the drum rotation shaft 41 may be fixed to the drum 30, and the other end of the drum rotation shaft 41 may be located outside the tub 20.

One end of the driving shaft 55 may be located inside the drum rotation shaft 41, and the other end of the driving shaft 55 may be fixed to the driving motor 53.

One end of the first pulsator rotation shaft 42 may pass through the bottom surface of the drum 30 and may protrude toward the open surface of the drum 30, and the other end of the first pulsator rotation shaft 42 may be located inside the drum rotation shaft 30.

The first gear assembly 45 may be disposed between said one end of the driving shaft 55 and the other end of the first pulsator rotation shaft 42 to transmit the rotational force transmitted by the driving shaft 55 to each of the drum rotation shaft 41 and the first pulsator rotation shaft 42.

Hereinafter, a method for driving each of the pulsator 103 and the agitator 105 included in the rotator 100 will be described in detail with reference to FIGS. 3 and 4.

Figure 3:
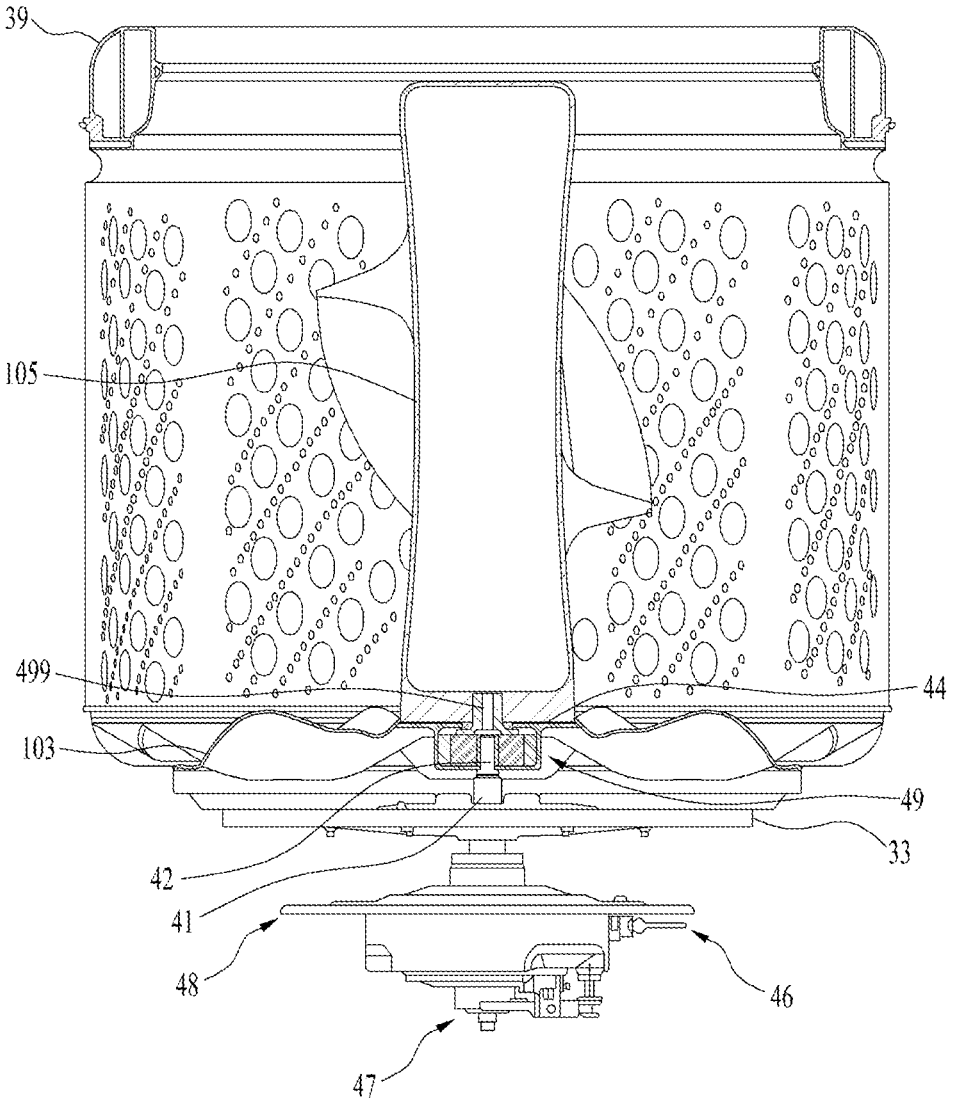
FIG. 3 is a view showing a second gear assembly for driving a rotator according to an embodiment of the present disclosure.
Figure 4:
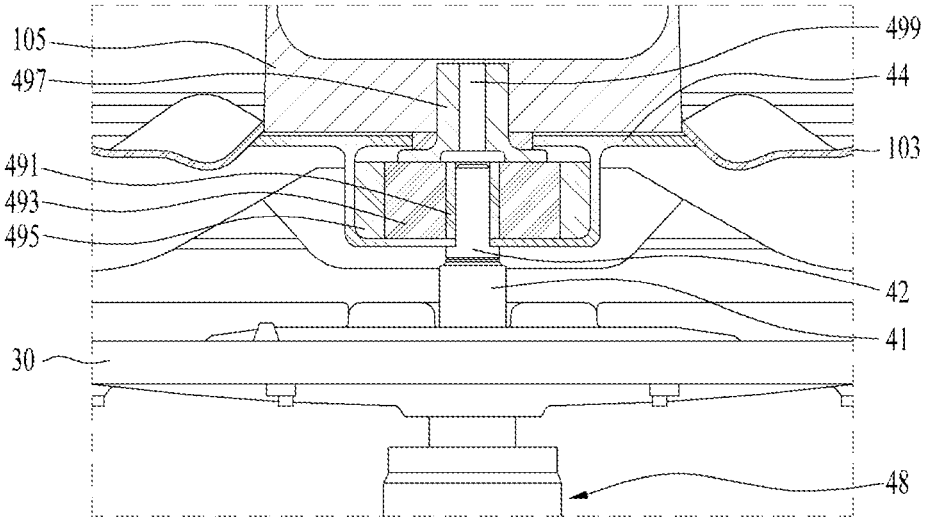
FIG. 4 is an enlarged cross-sectional view for illustrating a second gear assembly in FIG. 3.

FIG. 3 is a view showing a second gear assembly for driving a rotator according to an embodiment of the present disclosure, and FIG. 4 is an enlarged cross-sectional view for illustrating a second gear assembly in FIG. 3.

Referring to FIG. 3, the laundry treating apparatus 1 according to an embodiment of the present disclosure may further include the second gear assembly 49 that may distribute the rotational force transmitted from the first pulsator rotation shaft 42 to the pulsator 103 and the agitator 105, and adjust the rotation direction.

More specifically, the laundry treating apparatus 1 of the present disclosure may further include a second pulsator rotation shaft 44 that constitutes a central shaft of rotation of the pulsator 103 and provides a space in which one end of the first pulsator rotation shaft 42 is accommodated, an agitator rotation shaft 499 that is disposed to pass through a top surface of the second pulsator rotation shaft 44, and has one end fixed to the agitator 105 and the other end positioned inside the second pulsator rotation shaft 44, and a second gear assembly 49 that is disposed inside the second pulsator rotation shaft 44 and between one end of the first pulsator rotation shaft 42 and the other end of the agitator rotation shaft 499, and transmits the rotational force transmitted by the first pulsator rotation shaft 42 to each of the second pulsator rotation shaft 44 and the agitator rotation shaft 499.

In this connection, the pulsator 103 may be configured to rotate by the rotational force sequentially transmitted through the driving shaft 55, the first gear assembly 45, the first pulsator rotation shaft 42, the second gear assembly 49, and the second pulsator rotation shaft 44.

In one example, the agitator 105 may be configured to rotate by the rotational force sequentially transmitted through the driving shaft 55, the first gear assembly 45, the first pulsator rotation shaft 42, the second gear assembly 49, and the agitator rotation shaft 499.

The agitator 105 may be configured to rotate in the same direction as the rotation direction of the rotational force provided by the driving motor 53, and the pulsator 103 may be configured to rotate in a direction opposite to the rotation direction of the rotational force provided by the driving motor 53. That is, in other words, the pulsator 103 and the agitator 105 may be configured to rotate in the opposite directions.

Referring to FIG. 4, the second gear assembly 49 may include a second driving gear 491 rotatably disposed inside the second pulsator rotation shaft 44 and fixed to one end of the first pulsator rotation shaft 42, a second connecting gear 495 disposed along an inner circumferential surface of the second pulsator rotation shaft 44, a plurality of second driven gears 493 disposed along a circumferential surface of the second driving gear 491 to connect the second driving gear 491 with the second connecting gear 495, and a second cage 497 rotatably disposed inside the second pulsator rotation shaft 44 and rotatably fixing the plurality of second driven gears 493. The agitator rotation shaft 499 may be disposed to connect the second cage 497 with the agitator 105.

The second gear assembly 49 may transmit a rotational force in the same direction as a rotation direction of a rotational force transmitted by the first pulsator rotation shaft 42 to the agitator rotation shaft 499, and transmit a rotational force in a direction opposite to the rotation direction of the rotational force transmitted by the first pulsator rotation shaft 42 to the second pulsator rotation shaft 44.

Figure 5:
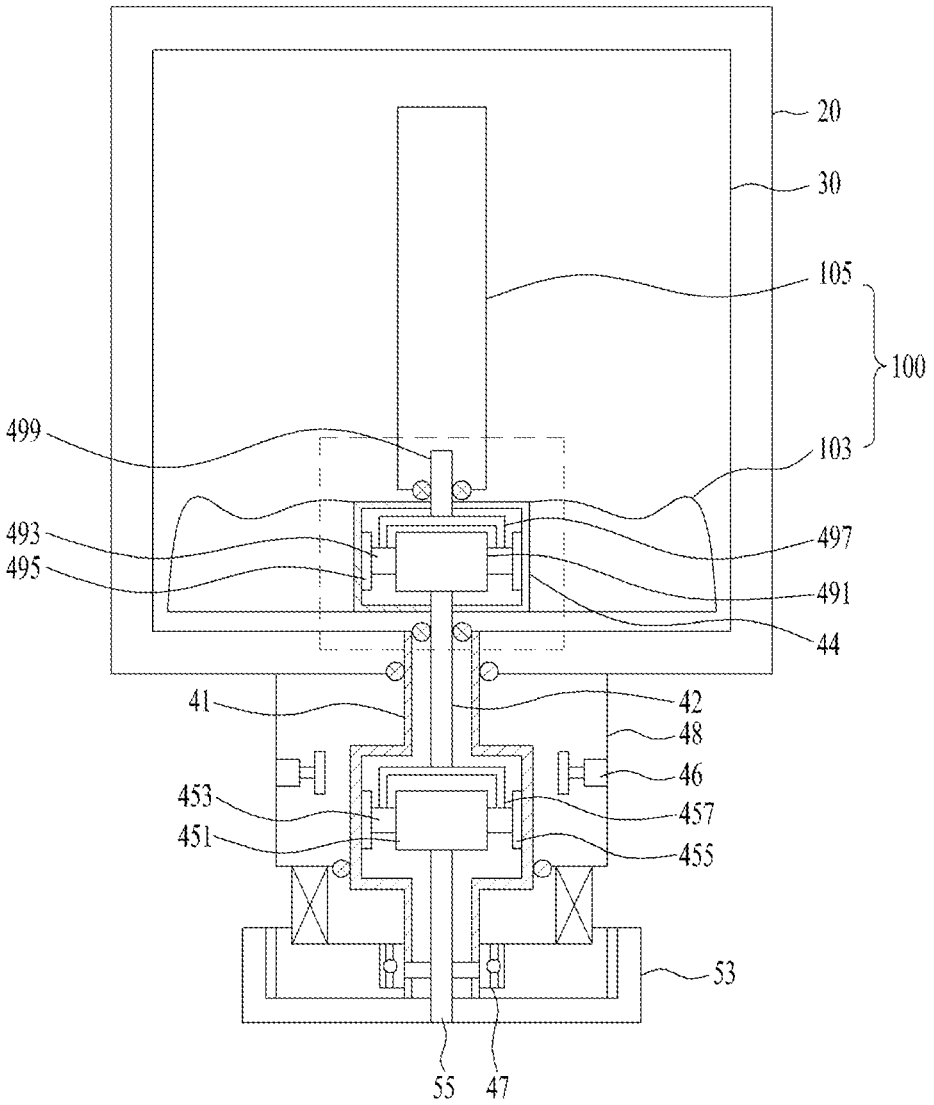
FIG. 5 is a schematic diagram for illustrating a method for driving a rotator according to an embodiment of the present disclosure.

FIG. 5 is a schematic diagram for illustrating a method for driving a rotator according to an embodiment of the present disclosure.

Referring to FIG. 5, the rotational force provided by the driving motor 53 may be transmitted to the first gear assembly 45 through the driving shaft 55. Thereafter, the rotational force may be transmitted to each of the drum rotation shaft 41 and the first pulsator rotation shaft 42 through the first gear assembly 45.

In this connection, the rotational force transmitted to the drum rotation shaft 41 may be used for the rotation of the drum 30, but the rotation of the drum 30 may be forced or restricted by the operation of the clutch 47 and/or the brake 46.

In one example, the rotational force transmitted to the first pulsator rotation shaft 42 may be transmitted to the second gear assembly 49. Thereafter, the rotational force may be transmitted to each of the second pulsator rotation shaft 44 and the agitator rotation shaft 499 through the second gear assembly 49.

A scheme in which the rotational force is transmitted through the first gear assembly 45 is as follows.

First, the first driving gear 451 fixed to the driving shaft 55 may be configured to spin in the same direction (hereinafter, referred to as a first direction) as the rotational direction of the driving shaft 55. Each of the plurality of first driven gears 453 may be configured to spin in a direction (hereinafter, referred to as a second direction) opposite to the rotation direction of the driving shaft 55.

In this connection, the plurality of first driven gears 453 may be configured to spin in the second direction, and at the same time, to orbit in the first direction around the first driving gear 451. Accordingly, the first cage 457, the first pulsator rotation shaft 42, and the second driving gear 491 may spin together in the first direction.

Thereafter, the second driving gear 491 fixed to the first pulsator rotation shaft 42 may be configured to spin in the first direction. Each of the plurality of second driven gears 493 may be configured to spin in the second direction. Accordingly, the second pulsator rotation shaft 44 and the pulsator 103 may rotate together in the second direction.

In one example, the plurality of second driven gears 493 may be configured to spin in the second direction, and at the same time, to orbit in the first direction about the second driving gear 491. Accordingly, the second cage 497, the agitator rotation shaft 499, and the agitator 105 may spin together in the first direction.

As a result, the pulsator 103 is configured to rotate in the second direction, which is the direction opposite to the rotation direction of the driving shaft 55. One the other hand, the agitator 105 may be configured to rotate in the first direction, which is the same direction as the rotation direction of the driving shaft 55.

Hereinafter, a rotational relationship between the drum 30, the pulsator 103, and the agitator 105 based on the operation of each of the clutch 47 and brake 46 will be described.

In one embodiment of the present disclosure, when the clutch 47 and the brake 46 are in a released state, based on a rotation relationship between the gears 451, 453, and 455 included in the first gear assembly 45, the drum rotation shaft 41 and the first pulsator rotation shaft 42 rotate in the opposite directions. Therefore, the drum 30 and the pulsator 103 may be configured to rotate in the same direction, or the drum 30 and the agitator 105 may be configured to rotate in the opposite directions.

In one example, when the brake 46 is in a restricted state, the rotation of the first connecting gear 455 and the drum rotation shaft 41 is restricted, and only the rotation of the first pulsator rotation shaft 42 is made. In this case, the drum 30 is in a stationary state and only the pulsator 103 and the agitator 105 rotate. In this connection, the pulsator 103 and the agitator 105 may be configured to rotate in the opposite directions.

In one example, when the clutch 47 is in the restricted state, the rotations of the driving shaft 55 and the drum rotation shaft 41 are mutually constrained, and the rotations of the driving shaft 55, the drum rotation shaft 41, and the first pulsator rotation shaft 42 may be mutually constrained depending on the gears 451, 453, and 455 included in the first gear assembly 45. That is, the drum rotation shaft 41 and the first pulsator rotation shaft 42 rotate in the same direction. Accordingly, the drum 30 and the pulsator 103 may be configured to rotate in the opposite directions, and the drum 30 and the agitator 105 may be configured to rotate in the same direction.

In one example, when the clutch 47 and the brake 46 are in the restricted state at the same time, the driving shaft 55, the drum rotation shaft 41, and the first pulsator rotation shaft 42 are all in the stationary state. The controller 70 may implement a required operation state by appropriately controlling the driver 50, the clutch 47, and the brake 46 in the washing process, the rinsing process, the dehydration process, and the like.

As described above, the pulsator 103 and the agitator 105 may be configured to rotate in the opposite directions. Accordingly, the laundry treating apparatus 1 may form a three-dimensional water flow.

In addition, the driver 50 may include the single driving motor 53 and the two gear assemblies 45 and 49, each of which is of the planetary gear-type. Accordingly, compared to a laundry treating apparatus using a plurality of driving motors, the structure may be simplified and the price competitiveness may also be improved.

Although various embodiments of the present disclosure have been described in detail above, those of ordinary skill in the technical field to which the present disclosure belongs will understand that various modifications are possible with respect to the above-described embodiment without departing from the scope of the present disclosure. Therefore, the scope of rights of the present disclosure should not be limited to the described embodiment and should be defined by the claims described later as well as the claims and equivalents.

What is claimed is:

1. A laundry treating apparatus comprising:

a tub configured to receive water;

a drum rotatably disposed inside the tub and configured to receive clothes, the drum having an open surface configured to receive the clothes therethrough and a bottom surface located at an opposite side of the open surface;

a pulsator rotatably disposed at the bottom surface of the drum;

an agitator that protrudes from the pulsator in the drum toward the open surface of the drum, the agitator being rotatably disposed at a center of the pulsator; and a driver configured to drive at least one of the drum, the pulsator, or the agitator, wherein the driver comprises:

a driving motor disposed outside the tub and configured to generate rotational force, a drum rotation shaft that passes through the tub, the drum rotation shaft having a first end fixed to the drum and a second end located outside the tub, a driving shaft having a first end located inside the drum rotation shaft and a second end fixed to the driving motor, a first pulsator rotation shaft having a first end that protrudes through the bottom surface of the drum toward the open surface of the drum and a second end that is located inside the drum rotation shaft, a first gear assembly disposed inside the drum rotation shaft, the first gear assembly being disposed between the first end of the driving shaft and the second end of the first pulsator rotation shaft and configured to transmit the rotational force from the driving shaft to each of the drum rotation shaft and the first pulsator rotation shaft, a second pulsator rotation shaft that defines a central axis of rotation of the pulsator and receives the first end of the first pulsator rotation shaft, an agitator rotation shaft that passes through a top surface of the second pulsator rotation shaft, the agitator rotation shaft having a first end fixed to the agitator and a second end located inside the second pulsator rotation shaft, a second gear assembly disposed inside the second pulsator rotation shaft, the second gear assembly being disposed between the first end of the first pulsator rotation shaft and the second end of the agitator rotation shaft and configured to transmit the rotational force from the first pulsator rotation shaft to each of the second pulsator rotation shaft and the agitator rotation shaft, and a clutch configured to:

transmit the rotational force from the driving motor to the drum rotation shaft based on connecting the driving motor and the drum rotation shaft to each other, and stop transmission of the rotational force from the driving motor to the drum rotation shaft based on separating the driving motor and the drum rotation shaft from each other, wherein the first gear assembly comprises:

a first driving gear rotatably disposed inside the drum rotation shaft and fixed to the first end of the driving shaft, a first connecting gear disposed along an inner circumferential surface of the drum rotation shaft, a plurality of first driven gears that are disposed along a circumferential surface of the first driving gear and connect between the first driving gear and the first connecting gear, and a first cage that is rotatably disposed inside the drum rotation shaft and rotatably supports the plurality of first driven gears, and wherein the first pulsator rotation shaft connects a top surface of the first cage to the second gear assembly.

2. The laundry treating apparatus of claim 1, wherein the pulsator is configured to be rotated by the rotational force that is transmitted in a sequence through the driving shaft, the first gear assembly, the first pulsator rotation shaft, the second gear assembly, and the second pulsator rotation shaft.

3. The laundry treating apparatus of claim 1, wherein the agitator is configured to be rotated by the rotational force that is transmitted in a sequence through the driving shaft, the first gear assembly, the first pulsator rotation shaft, the second gear assembly, and the agitator rotation shaft.

4. The laundry treating apparatus of claim 1, wherein the second gear assembly comprises:

a second driving gear rotatably disposed inside the second pulsator rotation shaft and fixed to the first end of the first pulsator rotation shaft;

a second connecting gear disposed along an inner circumferential surface of the second pulsator rotation shaft;

a plurality of second driven gears that are disposed along a circumferential surface of the second driving gear and connect between the second driving gear and the second connecting gear; and a second cage that is rotatably disposed inside the second pulsator rotation shaft and rotatably supports the plurality of second driven gears, and wherein the agitator rotation shaft connects the second cage to the agitator.

5. The laundry treating apparatus of claim 4, wherein the first driving gear is configured to rotate in a first direction that corresponds to a rotation direction of the driving shaft, and wherein each of the plurality of first driven gears is configured to rotate in a second direction that is opposite to the rotation direction of the driving shaft.

6. The laundry treating apparatus of claim 5, wherein the plurality of first driven gears are configured to rotate around the first driving gear in the first direction, and wherein the first cage, the first pulsator rotation shaft, and the second driving gear are configured to rotate together in the first direction.

7. The laundry treating apparatus of claim 6, wherein each of the plurality of second driven gears is configured to rotate in the second direction, and wherein the second pulsator rotation shaft and the pulsator are configured to rotate together in the second direction.

8. The laundry treating apparatus of claim 6, wherein the plurality of second driven gears are configured to rotate around the second driving gear in the first direction, and wherein the second cage, the agitator rotation shaft, and the agitator are configured to spin together in the first direction.

9. The laundry treating apparatus of claim 1, wherein each of the drum rotation shaft and the second pulsator rotation shaft is a hollow shaft having a through-hole therein, and wherein each of the first pulsator rotation shaft and the agitator rotation shaft is a solid shaft.

10. The laundry treating apparatus of claim 9, wherein the first pulsator rotation shaft extends through a portion of the through-hole of the drum rotation shaft and a portion of the through-hole of the second pulsator rotation shaft, wherein the first end of the first pulsator rotation shaft is disposed in the through-hole of the second pulsator rotation shaft, and the second end of the first pulsator rotation shaft is disposed in the through-hole of the drum rotation shaft, and wherein the agitator rotation shaft extends through an upper portion of the through-hole of the second pulsator rotation shaft.

11. The laundry treating apparatus of claim 1, wherein the driving shaft, the drum rotation shaft, the first pulsator rotation shaft, the second pulsator rotation shaft, and the agitator rotation shaft are coaxial.

12. The laundry treating apparatus of claim 11, wherein the driving shaft extends vertically above the driving motor, wherein the first gear assembly is disposed vertically above the driving shaft, wherein the first pulsator rotation shaft is disposed vertically above the first gear assembly, wherein the second gear assembly is disposed vertically above the first pulsator rotation shaft, and wherein the agitation rotation shaft is disposed vertically above the second gear assembly.

13. The laundry treating apparatus of claim 12, wherein the driving motor extends upward relative to the second end of the drum rotation shaft.

* * * * *